US006247620B1

(12) United States Patent
Makainai

(10) Patent No.: US 6,247,620 B1
(45) Date of Patent: Jun. 19, 2001

(54) (JUS PRESS) CLIP-ON DISPENSING ADAPTER FOR A PORTABLE WATER COOLER

(75) Inventor: Ernest Kalani Makainai, Keneohe, HI (US)

(73) Assignee: Ernest K. Makainai, Kaneohe, HI (US)

( * ) Notice: Subject to any disclaimer, the term of this patent is extended or adjusted under 35 U.S.C. 154(b) by 0 days.

(21) Appl. No.: 09/507,563

(22) Filed: Feb. 18, 2000

(51) Int. Cl.[7] ..... B67D 5/06
(52) U.S. Cl. ..... 222/185.1; 222/509
(58) Field of Search ..... 222/185.1, 518, 222/509

(56) References Cited

U.S. PATENT DOCUMENTS

| | | | | |
|---|---|---|---|---|
| 3,459,345 | * | 8/1969 | Chernak et al. | 222/518 |
| 4,715,516 | * | 12/1987 | Salvail | 222/509 |
| 4,996,847 | * | 3/1991 | Zickler | 62/3.64 |
| 5,385,273 | * | 1/1995 | Eddy et al. | 222/509 |
| 5,927,557 | * | 7/1999 | Busick et al. | 222/185.1 |

* cited by examiner

*Primary Examiner*—Philippe Derakshani

(57) ABSTRACT

A clip-on dispensing attachment for most if not, all of the portable water coolers that have the push-button system. The collar of the invention would clip-onto the body of the dispenser of the cooler in which by pressing onto the lever of the invention, it then becomes to have contact with the top of the push-in-button in which engages the releasing of the liquids.

1 Claim, 4 Drawing Sheets

(JUS PRESS) CLIP-ON DISPENSING ADAPTER FOR A PORTABLE WATER COOLER

BACKGROUND

1. Field of Invention

This invention relates generally to water, and other liquids,dispensing means and more particularly to such means for use in the dispensing of water or any other liquids from a portable water cooler.

2. Description of Prior Art

U.S. Pat. No. 4,996,847 to Mellisa Zickler (Dec. 20, 1989)

A beverage cooler and dispenser wherein bottled beverage are received into a housing member and the beverage therein is transfered by gravity to a cooling chamber comprising honeycomb beverage passageway. The beverage is thermoelectricdly cooled within the honeycombs passageways and selectively dispensed from the cooling chamber via a spigot fixedly attached to said housing member, therefore, While these units may be suitable for the particular purpose to which they address, They would not be suitable for the purpose of the present invention as heretofore described.

U.S. Pat. No. 5,385,273 to John W. Eddy and Kelley S Needham (Jan. 31, 1995)

A housing for mounting on a water dispenser which includes a compartment to extend over water dispensing spigots on the dispenser. The compartment has an aperture in it's top in which presser bars are positioned. The presser bars are pivotally supported by the housing and overlie the spigots to actuate them in a manner to reduce wear on and corresponding leakeage of their valves. The presser bars have large areas of contact to enable them to be depressed by persons of reduced finger strength by forming a leverage system which reduces the actuating force necessary to operate the spigots. therefore, the prior art mentioned is not directly related to the present invention and shows no purpose as described.

U.S. Pat. No. 4,715,516 to Salvail Napoleon (Dec. 29, 1987)

An apparatus for dispensing carbonated beverages and the like from a container has a body portion adapted to replace a screw top cap of the container. The body portion includes a tube which will project into the ullage volume of the container and will vent to the atmosphere via a normally closed vent valve. A normally closed fluid chamber and a spout. In use the container having the body portion attached thereto is essentially inverted and supported in a stand. A dispensing lever attached to the body is depressed and sequentially opens the vent valve and the fluid valve permitting the beverage to flow through the fluid chambers, the fluid valve and the spout by gravity. Therefore, while these units may be suitable for the particular purpose to which they address, they would not be suitable for the purposes of the present invention as heretofore described.

SUMMARY INCLUDING OBJECTS AND ADVANTAGES

A primary object of the present invention is to provide a improved method of dispersing fluid from a portable water cooler that will overcome the shortcomings of the prior art devices.

Another object is to make possible for children to serve themselves without the company of an adult.

Another object is to make possible for the mentally handicapped to serve themselves without the help of their doctors or nurses.

Another object is to make possible for the physically disabled to help themselves without the help of others.

Another object is to have any individual not familiar with the push button system for a portable water cooler to find that said invention makes it so easy to use by depressing onto tab with using only one finger instead of three fingers in order to release fluids from water cooler.

And still further object is to an easy to install clip-on dispencer attachment that is economical in cost to manufacture.

Accordingly, several objects and advantages of my invention are to provide a easier method of dispersing liquids from a portable water cooler that has a push button system or dispencer.

Another object is to provide a product that person(s) with physical disabilities would be able to utilize without the help of others.

Another object is to provide a product that person(s) with mental disabilities would be able to utilize without the help of others.

An additional object is to provide children to fend for themselfs without help from an adult.

A further object is to provide a shelf-explanitory way for persons not familiar with the push button system that's found on the portable water coolers to just press in order to dispence liquid from cooler container.

And still further object is to provide an economical, reliable,easy to fabricate, and highly durable, Moreover it can be easily utilized by anyone who gets in contact with said invention.

Still further objects and advantages will become apparent from a consideration of the ensuing description and accompanying drawings, Attention being called to the fact, however, that the drawings are illustrative only, and that changes may be made in the specific construction illustrated and described within the scope of the appended claims.

REFERENCE NUMERALS

Figure 2:
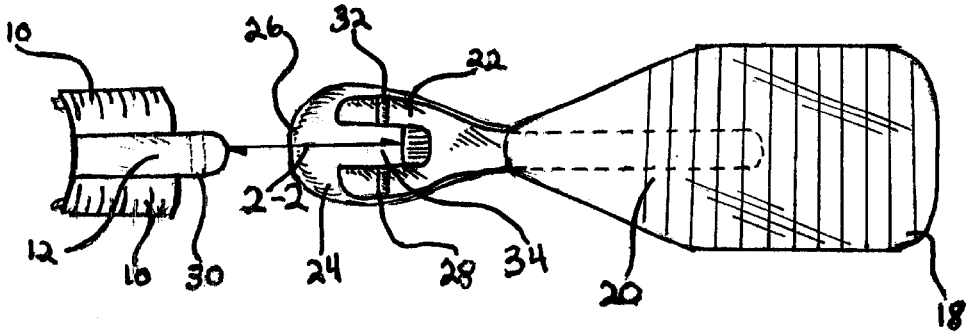
FIG. 2 is a top view of the invention detached from each other, showing where 2nd embodiment would connect to the main body of invention by arrows shown 2—2.
Figure 1:
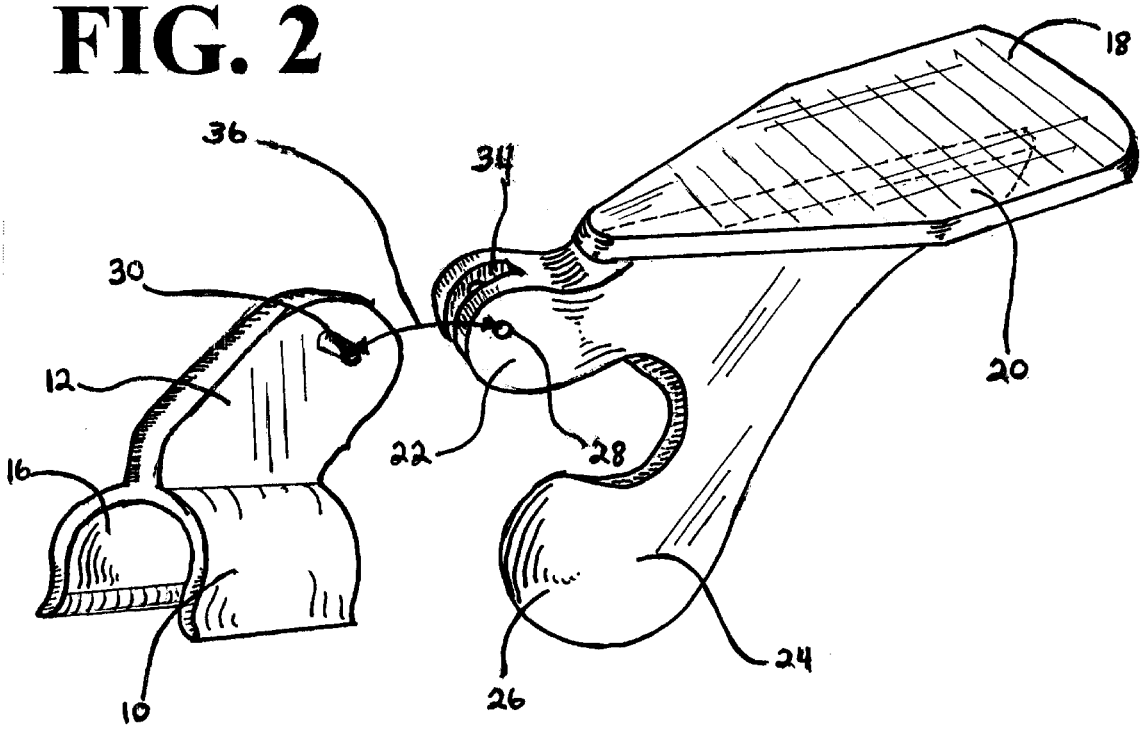
FIG. 1 is a perspective view of a first embodiment of the invention exploded away from the second embodiment of the invention.

10 outside of collar/2nd embodiment
12 Hinge neck of collar on (2nd embodiment)
14 hinge neck of main embodiment
16 inside of collar
18 top of press tab
20 support frame for press tab
22 main body hinge section
24 Plunger or Imitating finger
26 tip of plunger
28 hole for roller pin main embodiment
30 Hole for hinge neck for 2nd embodiment to 32
32 main body of plunger

34 Groove for hinge of 2nd embodiment to fit into
36 eyes meet together
38 plastic portable water cooler
40 push button spigot for cooler
42 Fluid/Liquid
44 cup
46 direction of plunger pushing inward for dispersing of liquids
48 Direction of tabs pressing downward to engage plunger with push button spigot.
50 spout
52 Holder where two fingers (Index and middle finger) would grasp onto for support.
54 thumb of person
56 Main body of water cooler dispencer.
58 Cover for portable water cooler.
60 brand name

PREFERRED EMBODIMENT—DESCRIPTION

Figure 3:
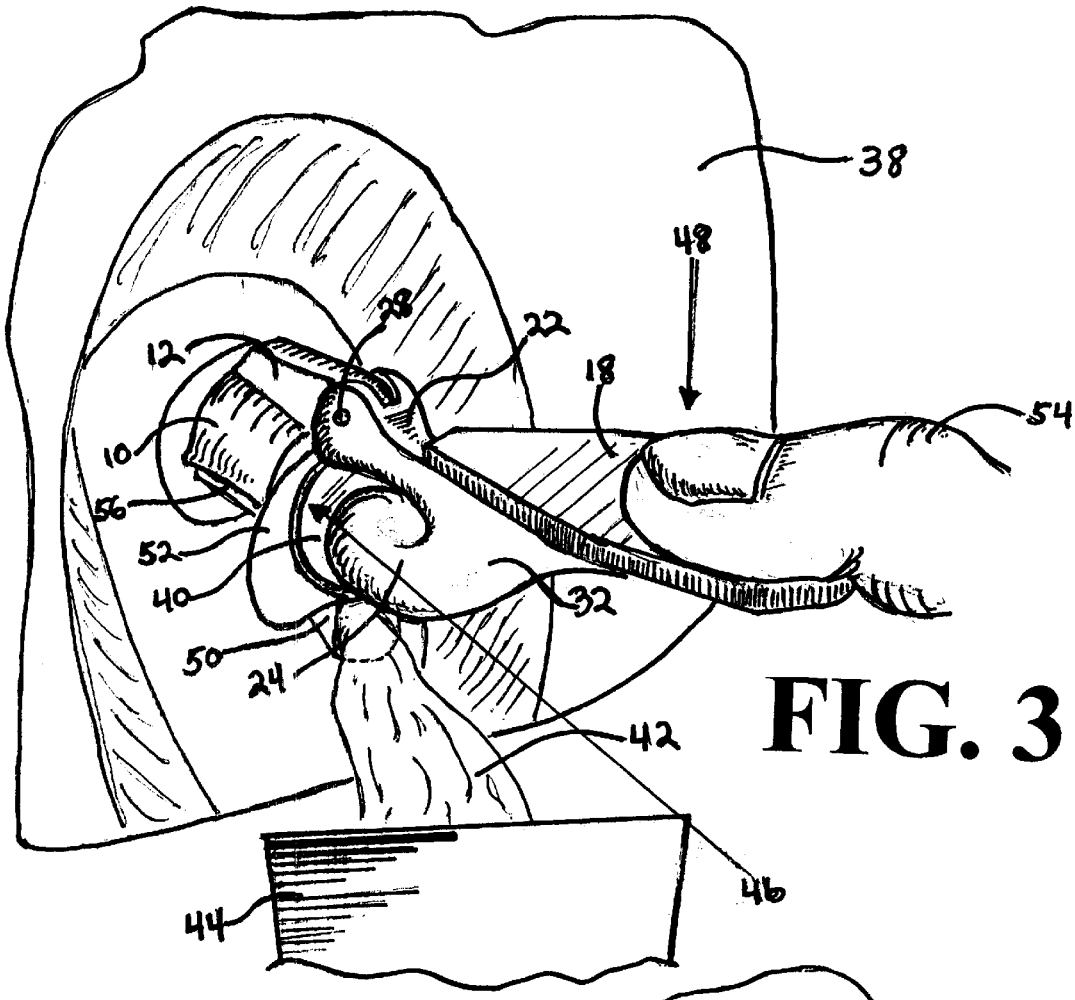
FIG. 3 shows a persons thumb pressing down on the tab of said invention to release fluid from portable water cooler.
Figure 4:
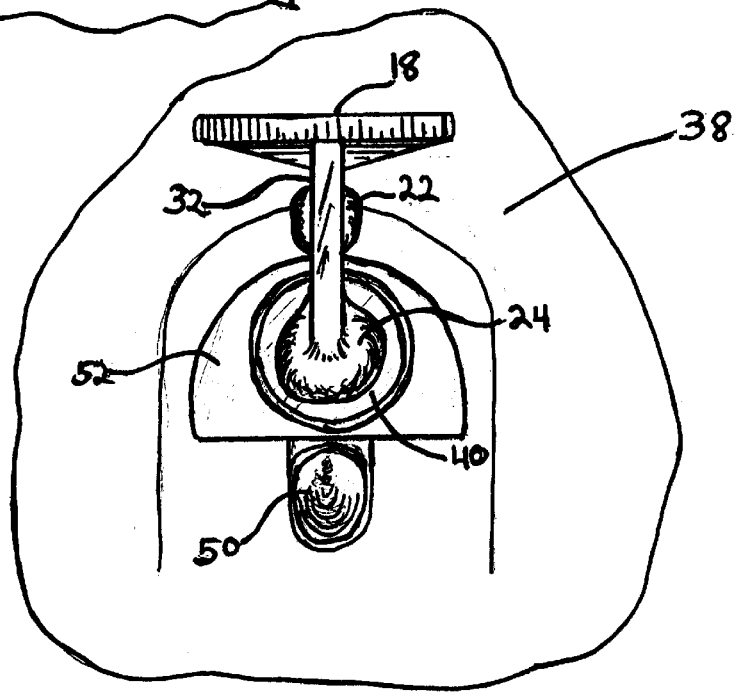
FIG. 4 is a front view of the portable water cooler dispenser with the rear view of the invention attached to the body of the dispencer.
Figure 5:
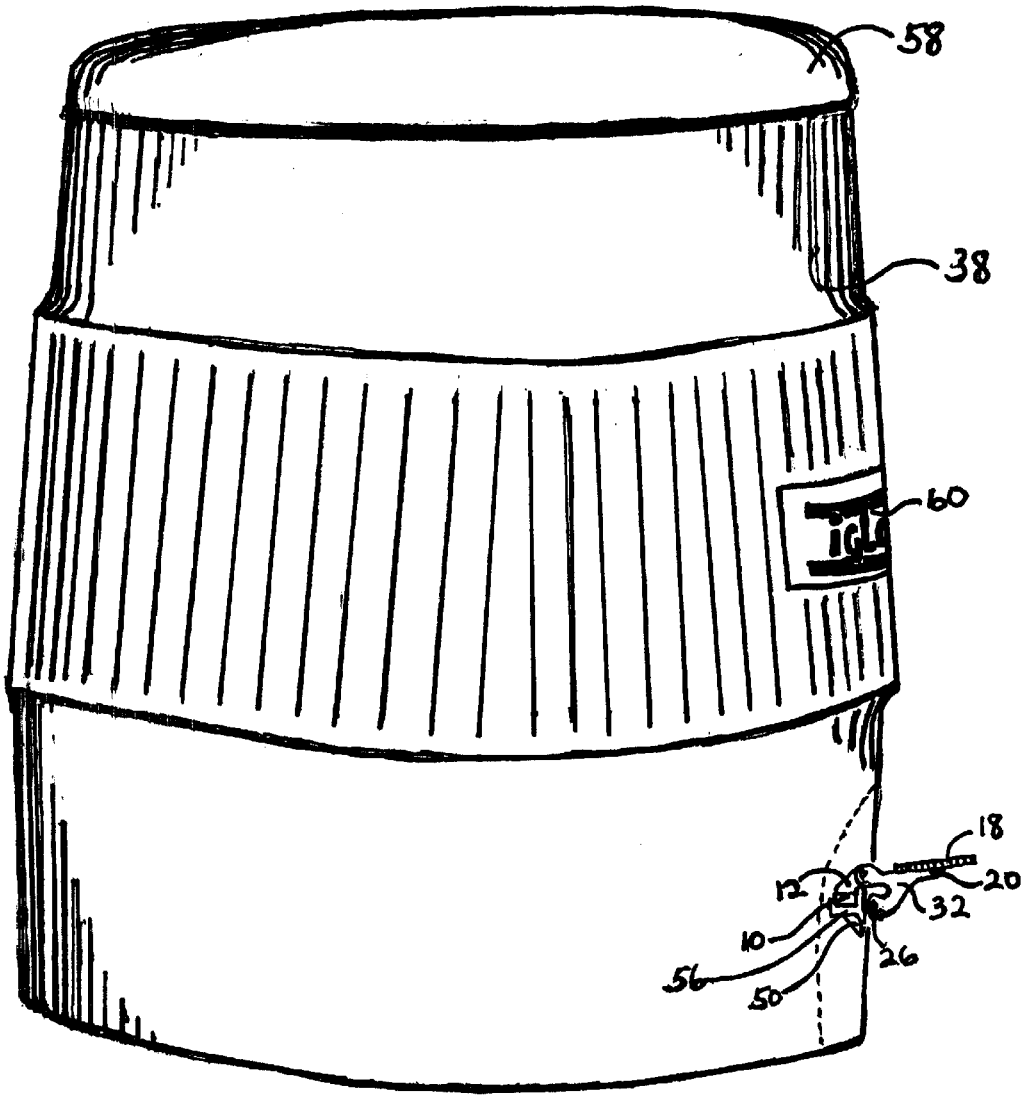
FIG. 5 shows a full size portable water cooler with the instant invention attached to the main body of the dispencer.
Figure 6:
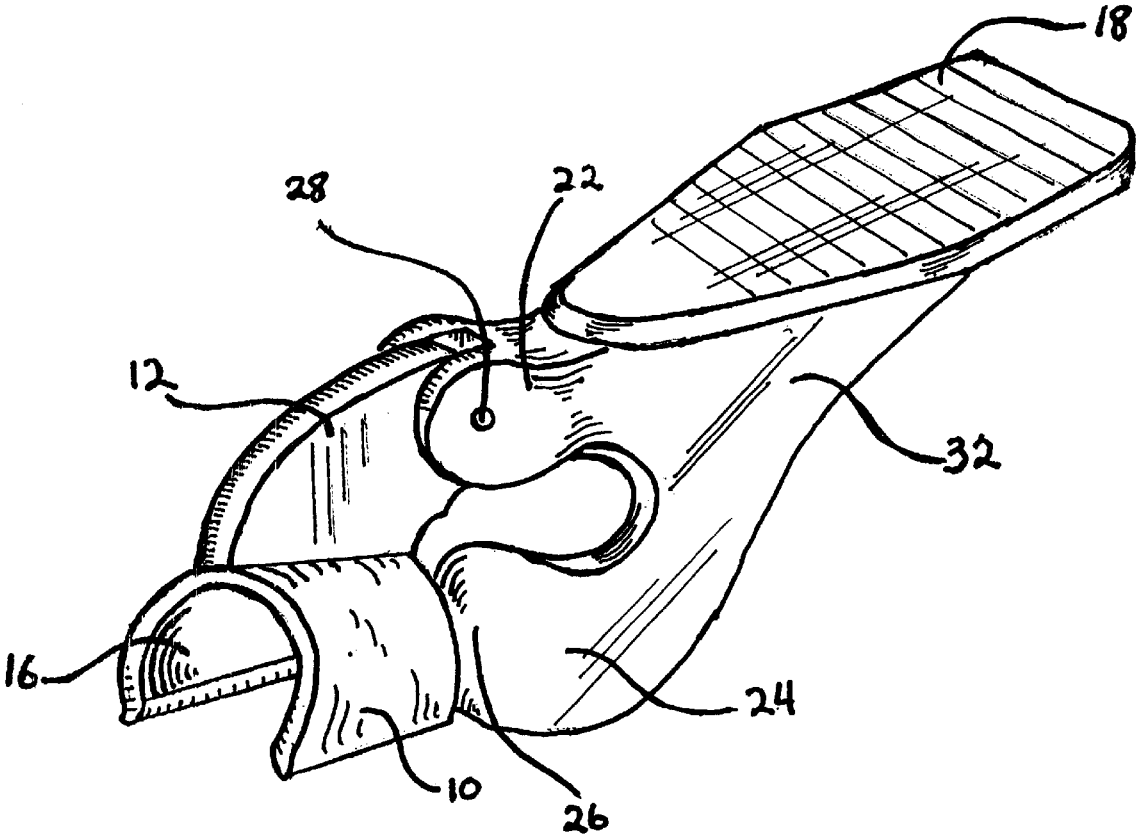
FIG. 6 is a perspective view of the invention.

Turning now descriptively to the drawings, the figures illustrate the main embodiment 32 with a tab 18 and a plunger 24 which imitates a persons finger. The second embodiment 12 connects with the main embodiment 32 by lining up the holes 28 and inserting a roller pin to comprise these two components together, thus completing both embodiments 32,12 to become one piece, Within two seconds the 2nd embodiment 12 inside collar 16 would be easily clipped on to the main body of the portable water coolers dispencer 56, From doing this it would be so simple to press onto the tab 18 which will then engage the plunger 24 to push in the button 40 of the portable water cooler 38 which then releases the fluids 42 that shows in "FIG. 3. FIG. 4 Shows a rear view of main embodiment 32 attached in place displaying where plunger 24 would push the button 40 of main water coolers dispencer 56, thus releasing fluid from water cooler 38 as previosly mentioned earlier from "FIG. 3, Which also shows from FIG. 3 The direction 48 with a finger or thumb 54 pressing down which then shows the direction 46 on how the plunger 24 then pushes the button to release fluids. FIG. 5 shows a full view of the portable water cooler38 with the instant invention clip-on attachment 32 in place.

PREFERRED EMBODIMENT—OPERATION

Operation and use of instant invention is so simple that if anybody was to see it for the first time, they would automatically know how to use it. FIG. 3 shows how a person would just depress down onto the press tab 18 in order to release the fluids being kept inside the portable water cooler. When begining to use the instant invention, you must first connect the collar 16 around the main body of the water cooler dispencer 56 so it would fit snugly on it, which by the way it takes only 2 seconds to clip on,After that,AII you do is press on the tab 18 and you got your refreshment, It's that simple.

CONCLUSIONS, RAMIFICATIONS, AND SCOPE

Accordingly, it can be seen that any persons,whether their children, physically impaired, persons not familiar with the push button system dispencer found on a portable water cooler, or persons operating a refreshment section in a marathon race or any sports game that the present invention would be the greatest improvement towards the portable cooler to make dispersing of liquids so much easier.

Although the description above contains many specificities, these should not be construed as limiting the scope of the invention but as merely providing illustrations of some of the presently preferred embodiments of this invention. Various other embodiments and ramifications are possible within it's scope. Many other ramification and variations are possible within there teachings of the invention. For example, the instant invention can be used with almost any type of push-in-button dispencer found on most of the portable water coolers.

Thus the scope of the invention should be determined by the appended claims and their legal equivalents, rather than by the examples given.

It will be understood that each of the elements described above, or two or more together may also find a useful application in other types of methods differing from the type described above.

While certain novel features of this invention have been shown and described and are pointed out in the annexed claims It is not intended to be limited to the details above, since it will be understood that various omissions, modifications, substitutions and changes in the forms and details for the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A clip-on dispensing attachment for a portable water cooler comprises a collar with a hinges a main body that also has a hinge that connects to the collar hinge a tab which is depressed upon a plunger, said clip-on attachment secures itself to the main body of a portable water cooler dispenser, said clip-on attachment having a clamp portion that fits snugly around said water cooler dispenser, said tab is a lever in which a person would depress in order to release liquid from said water cooler and said plunger is part of the tab.

* * * * *